United States Patent [19]

Yazawa

[11] 4,216,731

[45] Aug. 12, 1980

[54] AUTOMATIC BUTTONHOLE STITCH PROPORTIONING DEVICE FOR SEWING MACHINES

[75] Inventor: Fumihiko Yazawa, Utsunomiya, Japan

[73] Assignee: The Singer Company, Stamford, Conn.

[21] Appl. No.: 956,937

[22] Filed: Nov. 2, 1978

[51] Int. Cl.[2] ..... D05B 3/02; D05B 3/04; D05B 3/06

[52] U.S. Cl. ..... 112/158 B

[58] Field of Search ..... 112/158 B, 158 R, 66, 112/158 D, 158 F, 65, 111, 158 A

[56] References Cited

U.S. PATENT DOCUMENTS

| | | | |
|---|---|---|---|
| 3,263,635 | 8/1966 | Eguchi | 112/158 R |
| 3,306,242 | 2/1967 | Szostak | 112/158 B |
| 3,656,443 | 4/1972 | Ross | 112/158 B |
| 3,724,404 | 4/1973 | Marsh et al. | 112/158 B |
| 3,795,210 | 3/1974 | Adams et al. | 112/158 D |
| 3,834,332 | 9/1974 | Gude | 112/158 B |
| 4,019,449 | 4/1977 | Haut | 112/158 B |
| 4,106,418 | 8/1978 | Hayashi | 112/158 B |

FOREIGN PATENT DOCUMENTS

| | | | |
|---|---|---|---|
| 1007478 | 10/1965 | United Kingdom | 112/158 B |

*Primary Examiner*—Werner H. Schroeder
*Assistant Examiner*—Andrew M. Falik
*Attorney, Agent, or Firm*—Robert E. Smith; Edward L. Bell; William V. Ebs

[57] ABSTRACT

A buttonhole producing mechanism for a sewing machine is disclosed in which an operator influenced selector dial includes settings for providing two differently proportioned buttonholes. The selector dial is also connected with a zig-zag stitch width influencing mechanism in the sewing machine and arranged automatically to provide that width of zig-zag side stitches in a buttonhole which is appropriate for the selected buttonhole proportion.

5 Claims, 11 Drawing Figures

Fig. IOB

Fig. IOA

AUTOMATIC BUTTONHOLE STITCH PROPORTIONING DEVICE FOR SEWING MACHINES

DESCRIPTION OF THE INVENTION

This invention relates to a device for automatically controlling the proportions of a buttonhole on a sewing machine.

In recent years, many household sewing machines have been equipped with a mechanism for automatically stitching buttonholes. Methods for automatically stitching the buttonholes on a sewing machine can be divided generally into two methods, one of which is called "two-step buttonhole stitching" in which operator intervention is required at each end of the buttonhole so that a back stitch is effected by differently operating a feed cam while a buttonhole stitch cam, i.e., a bar-tack stitch cam and a side stitch cam are operated in an interlocked manner; and a second method, which is called "one-step buttonhole stitching", in which a feed cam for back stitching is interlocked with a bar-tack stitch cam and is automatically operated at one end of the buttonhole without operator intervention. With such conventional sewing machines, however, it was necessary to manipulate an amplitude control device to determine the widths of bar-tack stitch and side stitch when buttonholes of different sizes are to be stitched. For the users of the sewing machines, however, the operation of such an amplitude control device was very cumbersome.

The object of this invention, therefore, is to provide an automatic buttonhole proportioning control device for use in a sewing machine having buttonhole stitching mechanism utilizing either one or two step methods that is capable of performing the abovementioned operation by way of a simple manipulation. To accomplish the object according to this invention, a plurality of buttonhole stitch patterns of different sizes are indicated on the front surface of the sewing machine, and a suitable side stitch width with respect to a bar-tack stitch width can be obtained simply by selecting any one of the patterns.

The automatic proportioning control device according to this invention is illustrated below in detail with reference to an embodiment shown in FIGS. 1 to 10 of the accompanying drawings.

DESCRIPTION OF THE DRAWINGS

FIGS. 7, 8, and 9 are diagrammatic representations showing three different positions of adjustment of the automatic stitch width control device and the associated positions of adjustment of the stitch width influencing parts of the sewing machine zig-zag mechanism in which FIG. 7 shows the relationship of parts when the control disc cam 2 is set in other than a buttonholing position, FIG. 8 shows the relationship when a large buttonhole depicted at 90 in FIG. 1 is selected, and FIG. 9 shows the relationship when a small buttonhole depicted at 91 in FIG. 1 is selected, and FIGS. 10A and 10B are diagrammatic representations of large and small buttonhole stitch patterns, respectively.

Figure 1:
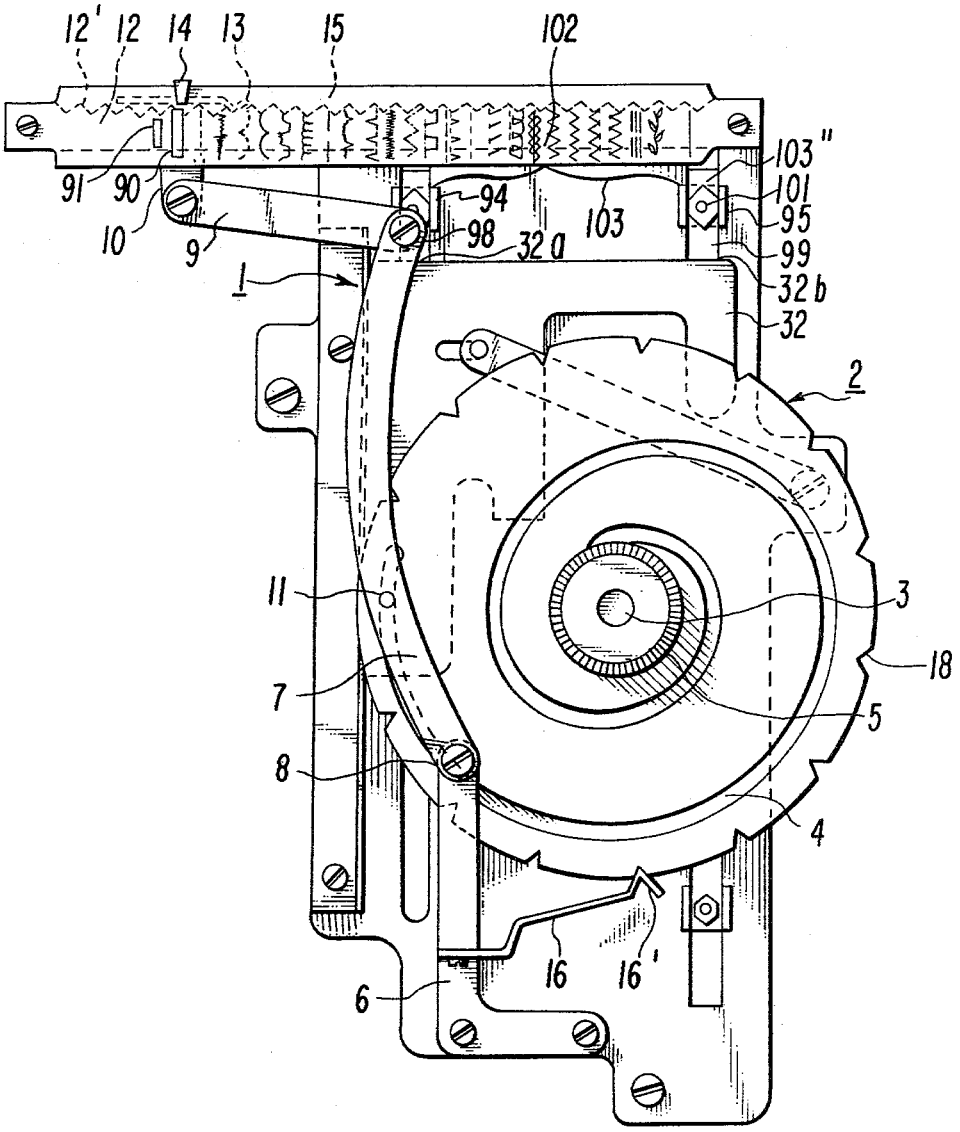
FIG. 1 is a front elevational view of an operator influenced control assembly for selecting a stitching pattern on a sewing machine.
Figure 4:
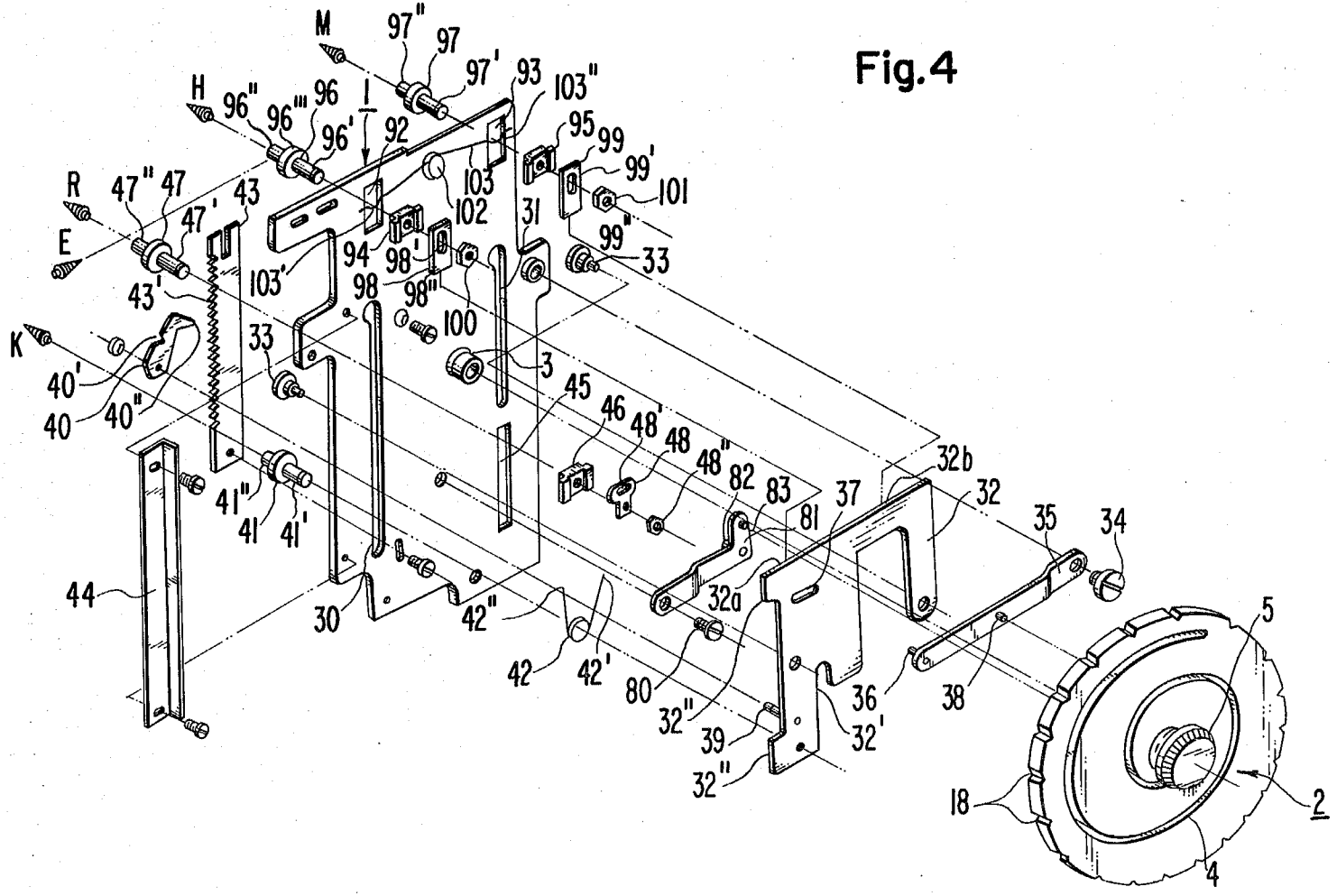
FIG. 4 is a perspective view of the control assembly of FIG. 1.

First as shown in FIGS. 1 and 4, a control disc cam 2 is rotatably mounted on a shaft 3 attached to the central part on the front surface of a mounting plate 1 of a rectangular form, said mounting plate 1 being installed in a sewing machine housing. A spiral pattern-selection groove 4 is formed on the front surface of the control disc cam 2 as shown in FIG. 1. The control disc cam 2 is integrally formed together with a control dial 5 so that the operation can be performed at the front surface of the sewing machine. Further, onto the lower part on the surface of the mounting plate 1 is fastened an L-shaped bracket 6. To the upper part of the bracket 6 is pivoted an end part of an arcuate indicia shifting lever 7 by means of a shouldered screw 8 and the other end of the lever 7 is linked to a vertical pointer carrying member 10 via a link 9. On the central upper surface of the indicia shifting lever 7 is affixed a follower pin 11 which will engage with the spiral pattern-selection groove 4 formed on the front surface of the control disc cam 2. On the upper side of the mounting plate 1, a planar slide plate 12 formed with a rack 12' on its upper portion is mounted parallel to and spaced above said mounting plate 1 maintaining a clearance from the top surface of said mounting plate 1. The pointer carrying member 10 is permitted to slidably move through the clearance between the slide plate 12 and the mounting plate 1, and the upper edge of the pointer carrying member 10 is so folded as to overlap the upper edge of the slide plate 12. A spring 13 attached to an end of the pointer carrying member 10 engages with the rack 12' in order to eliminate any looseness that may develop when a pointer 14 formed integrally with the pointer carrying member 10 is shifted.

On the front surface of the slide plate 12 is mounted a pattern plate 15 on which are inscribed a plurality of stitch patterns in a manner that such patterns will appear on the front surface of the sewing machine. The pointer 14 moves along the upper edge of the patterns to indicate any one of the stitch patterns. Further, to the bracket 6 is fastened an end of a disc cam spring 16. The other end 16' of the spring 16 is formed in a V-shape to engage any one of the grooves 18 of a number equal to the number of needle jogging pattern cams 52 that will be mentioned later in connection with FIG. 5, said grooves 18 being formed on the periphery of the control disc cam 2, whereby the position of parts corresponding to any stitch pattern indicated by the pointer 14 is determined and the positions of all of the cam followers, which will be mentioned later, are also determined. On the back surface of the control disc cam 2 rotatably mounted on the mounting plate 1 are further formed two spiral grooves as shown in FIG. 6, one being a zig-zag cam-selection groove 20 and the other being a feed cam-selection groove 21. FIG. 4 shows a mounting plate 1 with to vertically formed elongated slots 30, 31 that are arranged parallel with a cam shaft 50 which will be mentioned later (see FIG. 5). By attaching flanged pins 33, 33 to a rectangular operation plate 32 from the back surface of the mounting plate 1, the rectangular operation plate 32 is allowed to slide in the elongated slots 30, 31. Further, an end of an operation plate lever 35 is rotatably fitted to an upper side part on the front surface of the mounting plate 1 by means of a shouldered screw 34, and a pin 36 attached to the other end of said lever 35 slidably engages an elongated slot 37 formed on the operation plate 32 in a direction at right angles with the elongated slots 30, 31. A follower pin 38 affixed between the ends of the lever 35 engages the zig-zag cam-selecting groove 20 formed on the back surface of the control disc cam 2 (FIG. 6). A pin 39 is also affixed on the back surface of the operation plate 32; the pin 39 penetrates through the elongated slot 30 formed in the mounting plate 1 and rotatably holds a positioning latch 40 on the back surface of said mounting plate 1. Moreover, a shaft part 41' of a flanged positioning pin 41 projecting from the back surface of the mounting plate 1 and extending through the elongated slot 30, is affixed onto the back surface of the operation plate 32. To the shaft part 41' is fitted a base part of a wire spring 42, whereby one end 42' of the spring 42 is hooked to an arm 40' of the latch 40 and the other end 42" is hooked to a part 32' of the operation plate 32, so that the end 40" of the positioning latch 40 will engage a rack 43' which is formed at one end of a rack plate 43 which is adjustably mounted on the back surface of the mounting plate 1 in parallel with the elongated slot 30. Above the elongated slots 30, 31 of the mounting plate 1 are formed elongated holes 92, 93 in parallel to each other, and into these elongated holes are adjustably fitted slide blocks 94, 95 secured by fastening nuts 100, 101 to flanged positioning pins 96, 97 each having a threaded tip protruding through the holes formed at the center of said slide blocks in a manner that the mounting plate 1 is sandwiched therebetween via adjustor plates 98, 99. The lower parts 98", 99" of the adjustor plates 98, 99 will be so disposed as to come into contact with the upper parts 32*a*, 32*b* of the operation plate 32. Between the elongated holes 92 and 93 a wire spring 103 is attached to the mounting plate 1 by a pin 102 in such a manner that each end 103', 103" of the spring is in contact with the upper surface of one of the slide blocks 94, 95, respectively, to urge the blocks downwardly.

Furthermore, an elongated slot 45 is formed in the mounting plate 1 in parallel with the elongated slots 30, 31 and into said elongated slot 45 is slidably fitted a slide block 46 by means of a shaft 47' of a flanged feed positioning pin 47 which is inserted from the back surface of the mounting plate 1. A slide block adjustor plate 48 having a laterally elongated hole 48' is fastened at its base part to the slide block 46 by fastening a nut 48" threadly engaging shaft part 47' of the positioning pin 47. On the front surface of the mounting plate 1 an L-shaped slide block lever 81 is pivotally mounted at one end by means of a shouldered screw 80, and a pin 82 attached to the back surface of the lever 81 engages the laterally elongated hole 48' of the slide block adjustor plate 48. A pin 83 attached to the front surface of the slide block lever 81 at the other end thereof engages the feed cam selection slot 21 on the back surface of the control disc cam 2.

Figure 5:
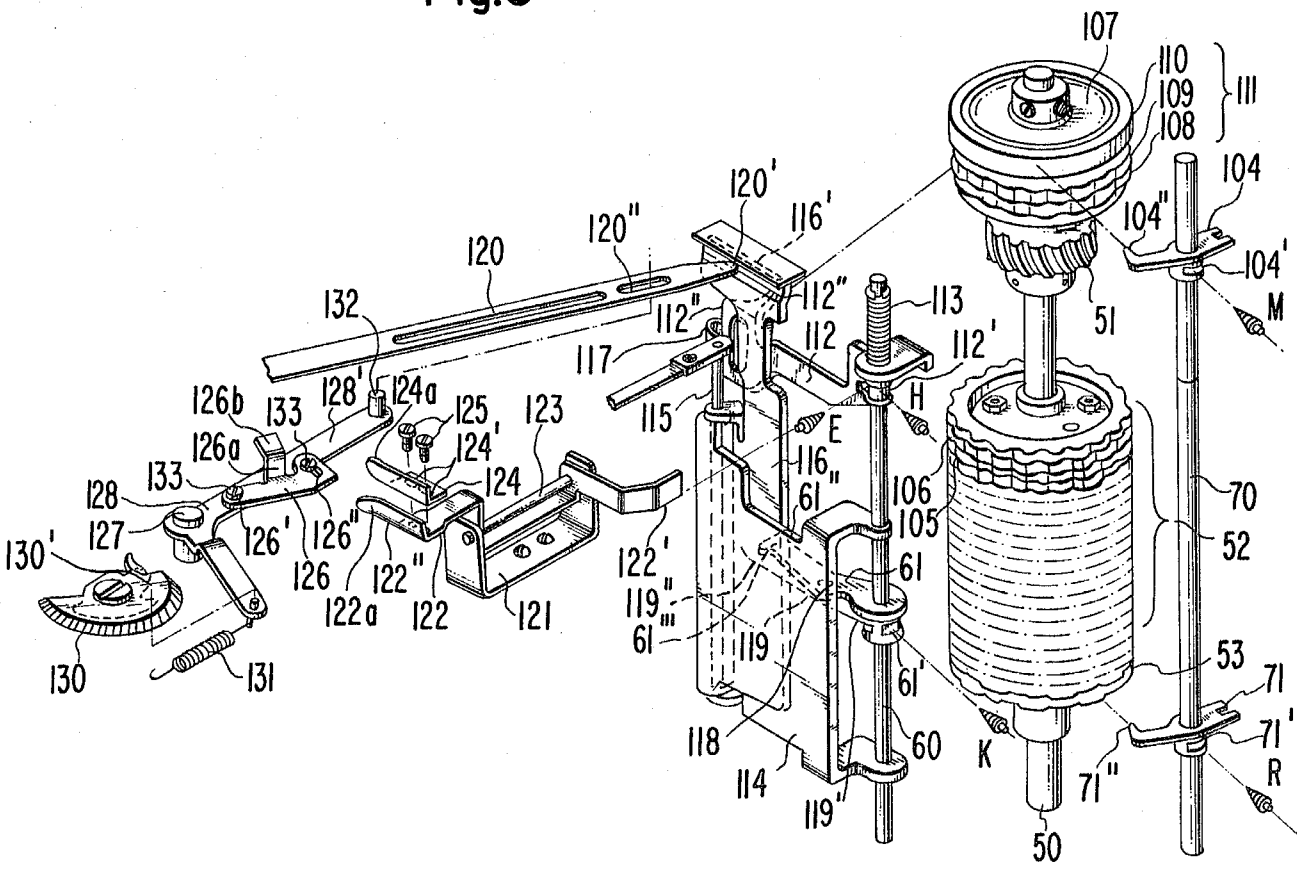
FIG. 5 is a perspective view of the sewing machine pattern cam stack, the cam follower, and the stitch width control device.
Figure 6:
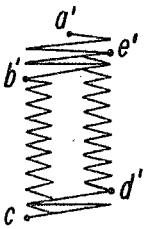
FIG. 6 is an elevational view of the inside surface of the operator influenced control disc.
Figure 6:
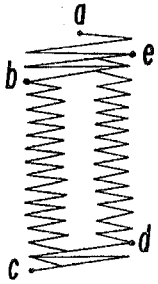
Figure 6:
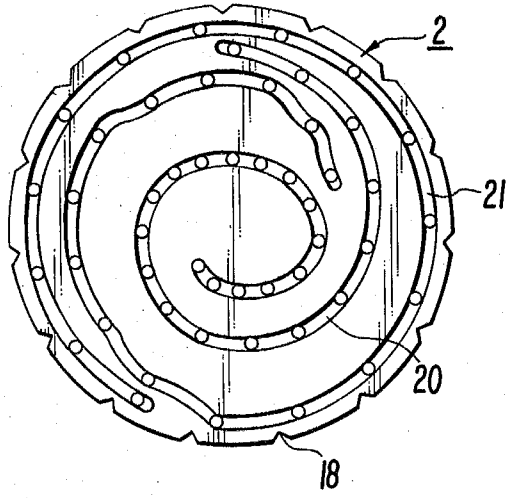
Figure 7:
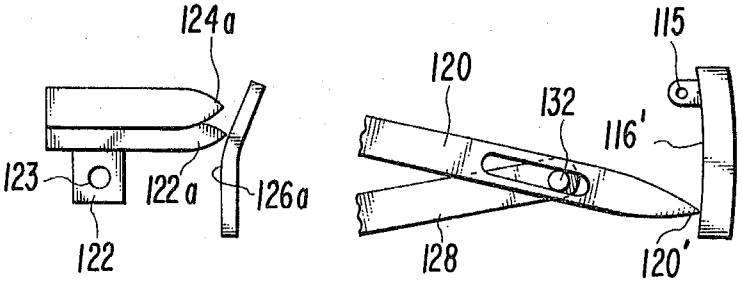

Further, as shown in FIG. 5, to a cam shaft 50 supported by the machine housing are attached a cam shaft gear 51, a plurality of needle jogging pattern cam discs 52, feed cam discs 53 and cam discs 111 for buttonhole making, whereby the rotation of an upper drive shaft in the sewing machine (not shown) is transmitted to the needle jogging pattern cam discs 52, feed cam discs 53 and the cams 111 for buttonhole making via the cam shaft gear 51. A zig-zag pattern follower shaft 60 is mounted on the machine frame in parallel with the cam shaft 50, onto said follower shaft 60 is slidably mounted a second cam follower 61, and. Onto a recessed part 61' formed at the base part of the second cam follower 61 is engaged an end 41" of the positioning pin 41 shown in FIG. 4. The second follower lever 61 has an end 61" which will always be contacted with pressure onto one of the pattern cam discs 52 due to the action of a spring 119 that will be mentioned later. On the surface of the mounting plate 1 (FIG. 4) is mounted an L-shaped operation plate guide 44, so that the operation plate 32 will be guided with its end parts 32", 32" formed at the upper and lower parts thereof being shiftable along the operation plate guide 44, and so that the operation plate 32 will smoothly move in the elongated slots 30, 31 by means of shouldered pins 33, 33.

A feed follower lever shaft 70 is mounted on the machine housing in parallel with the cam shaft 50, and onto the lever shaft 70 is slidably mounted a feed follower lever 71. To the recessed part 71 formed at the base part of the feed follower lever 71 is engaged an end 47" of the feed positioning pin 47. The end 71" of the feed follower lever 71 is brought into contact with pressure to the feed cam discs 53, or positioned at a place where said end 71" does not engage the feed cam discs 53 (below the feed cam discs in the drawing), being urged by a spring (not shown).

Further, on the upper part of the follower lever shaft 70 is slidably mounted a third cam follower 104 in the same way as said feed follower 71 is mounted, and with a recessed part 104' formed at a base part thereof is engaged an end 97" of the buttonhole feed positioning pin 97.

At the upper part of the cam shaft 50, a cam driver 107 is engaged with a buttonhole making cam 11 consisting of needle jogging cam discs 108, 109 and a feed cam disc 110, this cam package 111 for buttonhole making may be driven and controlled in any known manner, either in one or two step method for example as disclosed in U.S. Pat. Nos. 3,585,876 and 3,841,246, which are incorporated herein by reference, and preferably in a manner that the buttonhole cam 111 will operate only when the buttonhole is to be stitched. The cam disc 110 is provided at a position at which it will be engaged by an end 104" of a the third cam follower being urged by a spring (not shown).

Figure 2:
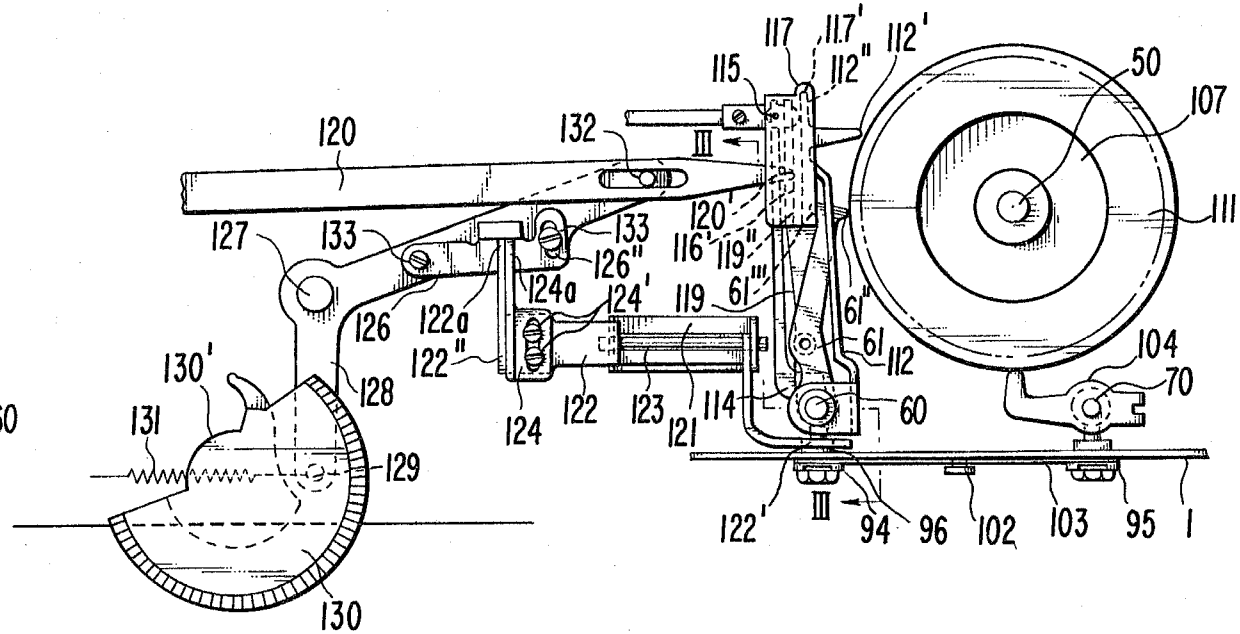
FIG. 2 is a top plan view of a fragment of the control assembly of FIG. 1 together with an automatic stitch width control device.
Figure 3:
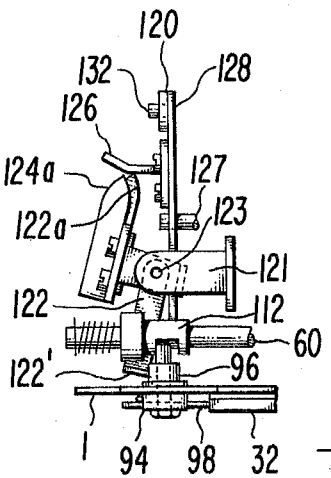
FIG. 3 is a cross sectional view taken substantially along line III—III of FIG. 2.

Moreover, at the upper part of the zig-zag pattern follower lever shaft 60 is slidably mounted a first cam follower 112 in such a manner that a recessed part 112' formed at a base part thereof is urged by a spring 113 to the end 96" of the bar-tack stitch positioning pin 96. Here, the end 112" of the first cam follower 112 is disposed at a position at which it will engage either one of the needle jogging cam discs 108 or 109 being urged by a spring (not shown). Further, at the lower part of the zig-zag pattern follower lever shaft 60, a wobble plate support member 114 is rotatably mounted to rotatably support a wobble plate 116 by means of a vertical stud 115 which is fastened to the other end. To the upper end part of the vertical stud 115 is fitted an end of a spring 117 which is formed in a U-shape and of which one end is folded in a circular shape, and into the U-shaped recess 117' of which is inserted an end of the first cam follower 112 (see FIG. 2).

The end 61'' of the second cam follower 61 is disposed between the wobble plate 116 and the needle jogging pattern cams 52. A spring 119 is attached to a pin 118 studded at the middle part of the second cam follower 61, whereby one end 119' is hooked to the second cam follower 61 and the other end 119'' is brought into contact with the wobble plate 116 to urge it toward the needle jogging pattern cams 52. Therefore, the wobble plate 116 is brought into contact with the end 61''' of the second cam follower 61 to push it, so that the end 61'' at the opposite side is forced to come into contact with the needle jogging pattern cams 52.

An end 120' of a control link 120 is urged to a cam surface 116' on the upper part of the wobble plate 116 due to the resilient force of a spring (not shown), and the other end is linked to a needle bar via a needle bar swinging arm (not shown). To a U-shaped support member 121 installed in the machine housing is rotatably fitted, by means of a shaft 123, a control lever 122, one end of which is L-shaped so that its end part 122' is positioned above a flange 96'' of the bar-tack stitch positioning pin 96, and the other end of which is also folded in an L-shape and has an end part 122'' further folded to define a pawl 122*a* which extends in a direction opposite to the end part 122'. Further, an L-shaped automatic control plate 124 has a pawl 124*a* of the same shape as the pawl 122*a* and has a bottom plate with elongated holes 124', 124'. The automatic control plate is mounted on the end of said control lever, by fastening screws 125, 125 that extend through the elongated holes 124', 124', and into the control lever 122 whereby the pawl 124*a* is positioned slightly higher than the pawl 122*a*. The pawls 122*a*, 124*a* will be located at such a position as to always come into contact with a slant part 126*b* of the control plate 126 which will be mentioned later.

Moreover, an L-shaped biasing lever 128, to the ends of which are fastened pins 129 and 132, is rotatably mounted on a stud 127 which is fixed on a machine housing. The pin 129 is usually forced by means of a spring 131 to come into contact with the cam surface of a cam 130' provided on the back surface of a control dial 130 which can be manually operated by hand at the front surface of the sewing machine. However, when the buttonholes are to be stitched, the control dial 130 is turned so that the cam 130' will not contact the pin 129. The pin 132, on the other hand, is slidably engaged with an elongated hole 120'' formed near the end part of the control link 120. On the central part of an arm 128' having the pin 132 is adjustably mounted a control plate 126 for controlling the biasing lever. The control plate has a slant end part 126*b* and a vertical rod part 126*a* and is attached to the arm 128 by fastening screws 133, 133 via a mounting hole 126' and a mounting elongated hole 126''.

The device of this invention is constructed as mentioned in the foregoing. The operation of the device is described below.

First, when a pattern is to be selected, the second cam follower 61, which is forced to come into contact with the needle jogging pattern cam discs 52 by the action of the spring 119, that biases the follower 61, and another spring (not shown), that biases the lever 71, are turned about the zig-zag follower lever shaft 60 and the feed follower lever shaft 70, respectively and acquire a released state. The mechanism for effecting the above-mentioned operation, however, is not included in the scope of this invention, and is not illustrated here.

To select either one of the buttonhole stitch proportions pattern 90 or 91 having different sizes indicated on the front surface of the sewing machine, the control dial 5 is turned to shift the pointer 14 and to set it at an indicated pattern.

As the control dial 5 is turned, the operation plate lever 35 having a pin 38 engaged with the zig-zag pattern cam selection groove 20 provided on the back surface of the control disc cam 2 is turned about the shoulder screw 34 as a fulcrum in cooperation with the follower pin 11 of the indicia shifting lever 7. The pin 36 attached to the other end of the lever 35 is engaged with the elongated slot 37 of the operation plate 32, and further, the operation plate 32 is attached to the mounting plate 1 by means of flanged pins 33, 33 in a manner to slide in the elongated slots 30, 31. Therefore, by turning the control dial 5, the operation plate 32 is raised by the action of the wire spring 42 and is guided by the operation plate guide 44. In this case, since the lower end 99'' of the adjustor plate 99 is in contact with the upper end 32*b* of the operation plate 32, the adjustor plate 99 is pushed up in opposition to the force of the spring 103 that presses downwardly on the slide block 95. The buttonhole feed positioning pin 97 fastened to the adjustor plate 99 pushes up the third cam follower 104 engaging therewith until the end 104'' thereof comes into engagement with the feed cam disc 110.

Further, the upper end 32*a* of the operation plate 32 is contacting the lower end 98'' of the adjustor plate 98; hence, in the same manner as above, the first cam follower 112 is pushed upwardly via the pin 96 against the forces of the spring 103 and the wire spring 113. In this case, one end 112'' of the first cam follower 112 is sandwiched by the U-shaped spring 117, but is allowed to slide in the up and down directions. Hence, the end 112'' of the first cam follower 112 is pushed up to a position at which it will engage the needle jogging cam disc 108.

The operation plate 32 is further equipped with a positioning pin 41 which projects through the elongated slot 30 of the mounting plate 1, the end 41'' of said pin 41 being engaged with the recess 61' of the second cam follower 61. Therefore, the operation plate 32 so moves that the second cam follower 61 is raised along the zig-zag pattern follower lever shaft 60, whereby the end 61'' of the second cam follower 61 selects one of the needle jogging pattern cams 52. In this case, the second cam follower 61 slides in the upper and lower directions under a state in which the wobble plate 116 is sandwiched by the end 61''' of the second cam follower 61 and the end 119'' of the wire spring 119 attached to the second cam follower.

The control lever 122 supported by a support member 121 via a shaft 123 has an L-shaped end part 122' which has been lowered by its own weight to come into contact with the pin 96. If the pin 96 for determining the position of the bar-tack stitch is raised, the flange 96''' thereof serves to push up the end 122' of the control lever 122. Hence, the arm 122'', on the other side of which is mounted the automatic control plate 124 is lowered with the shaft 123 as a fulcrum. That is, the pawls 122*a*, 124*a* turn with the shaft 123 as a fulcrum, whereby the pawl 122*a* which had been in contact with the slant part 126*b* of the control plate 126 works to push the control plate 126 against the force of the wire spring 131 and comes into contact with the vertical part 126*a*. Therefore, the biasing lever 128 turns with the shaft 127 as a fulcrum, and the pin 132 secured thereon slides along the elongated hole 120'' of the control line and turns with the fulcrum (not shown) of the swinging arm as a center so that the end 120' will cause the cam surface 116' of the wobble plate 116 to move toward the vertical stud 115.

In the foregoing was mentioned the operation for obtaining a large buttonhole stitch pattern 90. To obtain a second buttonhole stitch pattern 91, which is smaller than the above said pattern 90, the operation will be as mentioned below.

The control dial 5 is further turned, until the buttonhole stitch pattern 91 is selected by the pointer 14, whereby the third cam follower 104 is further raised in the same manner as mentioned earlier. However, the third cam follower 104 remains in contact with the same feed cam disc 110, since the feed cam disc 110 has a thickness greater than the distance by which said third cam follower 104 is raised. The second cam follower 61 is raised in the same manner as above and is forced to come into contact with the needle jogging cam disc 106 placed on, and having the same shape as, the needle jogging cam disc 105.

The first cam follower 112 is further raised by the positioning pin 96 to a position that brings it into engagement with the first cam disc 109 just above the first cam disc 108. At the same time, the L-shaped end 112' of the control lever 122 is further lifted by the flange 96''' of the positioning pin 96, which causes the arm 122'' on the opposite side to be further turned downwardly with the shaft 123 as a fulcrum. The pawl **124*a* is so mounted as to protrude a little beyond the pawl 122*a* so that, even though the pawl 122*a* may separate from the vertical part 126*a* of the control plate 126, the pawl 124*a* of the automatic control plate 124 engages the vertical part 126*a* to push it, and causes the biasing lever 128 to turn with the stud 127 as a fulcrum, in order that the end 120' of the control link 120 is further moved toward the vertical stud 115 along the cam surface 116' of the wobble plate 116**.

Below is described the operation for stitching the thus selected buttonhole stitch patterns.

First, if the sewing machine is set to stitch a large buttonhole pattern by turning the dial 5 to move the pointer 14 to the large buttonhole indicator 90, the first cam follower 112 comes into contact with needle jogging cam disc 108, the second cam follower 61 comes into contact with a needle jogging cam disc 105 in the stack 52, and the third cam follower 104 comes into contact with the forward stitching cam surface of the feed cam disc 110. As the main spindle (not shown) of the sewing machine is turned under this state, the cam shaft is turned at a reduced speed via the cam shaft gear 51 engaged with said main shaft. Onto the cam shaft 50 have been fastened a buttonhole cam driver 107 and the needle jogging pattern cams 52. When the bar-tack stitching is to be effected, first, the cam driver 107 engages a buttonhole cam 111 composed of the needle jogging cam disc 108 and the feed cam disc 110, and turns together with the needle jogging pattern cam discs 52. The needle jogging cam disc 108 has a crest, the height of which is equal to the width of the bar-tack stitch, and the swinging motion of the first cam follower 112 which has been forced to be in contact with the crest is transmitted to the wobble plate 116 via the U-shaped spring 117 fitted to the vertical stud 115. The wobble plate 116 is connected to the zig-zag adjustor support member 114 by means of the vertical stud 115, and the support member 114 is rotatably supported by the zig-zag pattern follower lever shaft 60 fixed on the machine housing. Accordingly, the wobble plate 116 undergoes swinging motion with the lever shaft 60 as a fulcrum.

The needle jogging cam disc 105 in the stack 52 is turned in phase with and in synchronism with the needle jogging cam disc 108 in the buttonholing unit 111, and further, the wobble plate 116 presses the second cam follower 61 against the needle jogging cam disc 105 in the stack 52 due to the action of the spring 119. Therefore, the wobble plate 116 oscillates with the vertical stud 115 as a fulcrum, and oscillates virtually in parallel as translated by the height of the crest of the needle jogging cam disc 108, which acts on the wall plate by way of the first cam follower 112. The swinging or oscillating motion of the wobble plate 116 is transmitted to the needle rod (not shown) via the control link 120.

Figure 8:
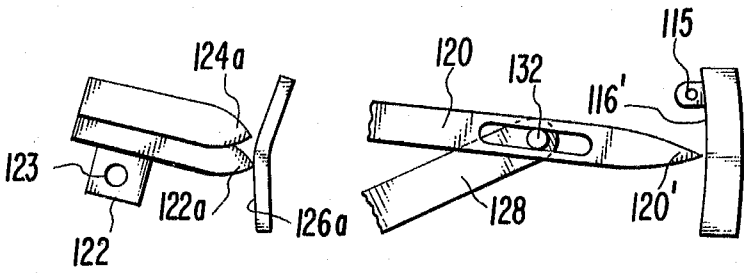

At this moment, the third cam follower 104 is in contact with the forward cam surface of the feed cam disc 110. By the above-mentioned operation, if the bar-tack stitching is performed from a point a to a point b on the buttonhole shown in FIG. 10A, the first cam follower 112 oscillates no more even if the needle jogging cam disc 108 is continued to run, since the needle jogging cam disc 108 has been so formed that the operation of the first cam follower 112 will stop at the point b. Instead, only the second cam follower 61 then transmits oscillatory motion to the wobble plate 116 from the second cam disc 105. Therefore, the wobble plate 116 oscillates with the vertical stud 115 as a fulcrum (zig-zag adjustor support member 114 does not oscillate), and the oscillatory motion is transmitted to the needle rod via the control link 120, so that the side stitching of any length is effected from the point b to the point c. In this case, the needle jogging cam disc 108 and the feed cam disc 110 cease to rotate after they turned about a half from the start of the bar-tack stitching, and thereafter, the cam driver 107 and the needle jogging cam disc 105 in the stack 52 turn to perform the side stitching. Next, if the step of backward feed is set by a separate operation means (not shown), the cam driver 107 engages again the needle jogging cam disc 108 and the feed cam disc 110, and begins to turn together therewith. In this case, the third cam follower 104 comes into contact with the backward stitching cam surface of the feed cam disc 110, and the first cam follower 112 comes into contact with the cam surface of the needle jogging cam disc 108, to perform the bar-tack stitching from the point c to the point d. Thereafter, the side stitching is performed from the point d to the point e by the same manner as the aforementioned forward stitching thereby to complete a buttonhole stitching. The operations mentioned in the foregoing have been taught in the specifications of U.S. Pat. No. 3,585,876 and U.S. Pat. No. 3,841,246. As mentioned above, the bar-tack stitching is performed by the needle jogging cam disc 108, and the side stitching is performed by the needle jogging cam disc 105 in the stack 52. However, in the case when only one size of buttonhole is to be stitched, a proper side stitching can be obtained with respect to the bar-tack stitching by adjusting the position of the control plate 126 which the pawl **122*a* of the control lever 122 will engage by way of the elongated hole 126'' and by fastening the control plate 126 in position by means of the screw 133, so that the end 120' of the control link 120 which the pin 132 of the biasing lever 128 will engage is placed in position on the cam surface 116'** located at a proper distance from the vertical stud 115 from the wobble plate 116, and so that the control link 120 is oscillated over a desired amplitude with the vertical stud 115 as a fulcrum (see FIG. 8).

Figure 9:
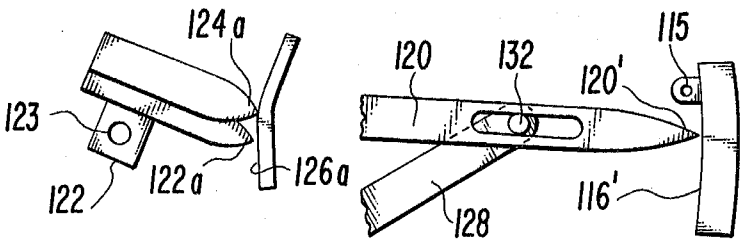

In this way, according to this invention, a plurality of sizes of buttonholes can be stitched. According to the embodiment illustrated with reference to the drawings, a smaller buttonhole, as shown in FIG. 10B of the two buttonholes in FIGS. 10A and 10B, is formed by bar-tack stitching determined by the height of the crest of the cam 109. The control dial 5 is turned so that the indicator 14 moves to the pattern 91 and the first cam follower 112 is forced to come in contact with the needle jogging cam disc 109 having the crest which is lower than the crest of the previously selected needle jogging cam disc 108. As a result, a narrower bar-tack stitch pattern is formed from a' to b' in FIG. 10B. Further, the second cam follower 61 comes into contact with the needle jogging cam disc 106 in the stack 52 provided just above the cam disc 105 and having the same shape as said cam disc 105, whereby the positioning pin 96 further pushes up the end 122' of the control lever 122 and further pushes down the pawl 122*a* of the opposite side. In this case, if there does not exist the automatic control plate 124, the pawl 122*a* of the control lever 122 will further push the vertical part 126*a* of the control plate 126. However, the pawl 122*a* has been so adjusted to the width of the side stitching of the buttonhole that its operation is too small to create sufficient oscillating amount of the control link 120. That is, the distance from the vertical stud 115 to the end 120' of the control link 120 is too large causing the control link 120 to oscillate excessively. Therefore, in the case of stitching small buttonholes, the side stitch width is too great as compared to the bar-tack stitch width making it hard to obtain proper buttonhole stitch. Therefore, the automatic control plate 124 having another pointed end 124*a* is adjustably mounted on the control lever 122 by way of the elongated holes 124', 124' being fastened with screws 125, 125. Accordingly, in the case of stitching small buttonholes, the pointed end 124*a* is pressed to the vertical part 126*a* of the control plate 126, and the movement is transmitted to the end 120' of the control link 120 in the same manner as mentioned earlier, and the end 120' is placed in position on the cam surface 116' which is properly separated from the vertical stud 115 of the wobble plate 116, in order that a proper side stitch, as shown between locations b' and c' in FIG. 10B width of the small buttonhole stitching can be obtained automatically (see FIG. 9). Thereafter, the second bar-tack stitch from c' to d' and the second narrow side stitch from d' to e' can be obtained by reengaging the appropriate cams 108 and 106 in a manner similar to that in the case of the larger buttonhole in FIG. 10A. Such reengagement takes place automatically. Although the foregoing embodiment has dealt with the case of stitching buttonholes having two different sizes, it should be noted that the buttonholes having three or more different sizes can also be stitched easily with the device of this invention by employing additional pawls to properly adjust the moving amount of the control link.

Using the automatic buttonhole stitch length control device of this invention, as mentioned above, it is made possible to adjust the device to suit for stitching a plurality of buttonholes having different sizes by way of a simple operation, and in addition, a proper side stitch width can be automatically obtained responsive to the size of the bar-tack stitch of the selected buttonhole.

From the foregoing description, it will be understood that the device of this invention is very useful.

I claim:

1. An automatic buttonhole proportioning control device for a sewing machine having zig-zag needle support means, a control dial for selecting any one of a plurality of different indicated buttonhole stitch proportions, and indicating means connected to said dial and controlled thereby and capable of sewing buttonhole pattern having said stitch proportions, said actuating means comprising:

needle jogging cam means;

needle jogging follower means;

feed cam means;

feed follower means;

linking means mechanically influenced by said control dial for simultaneously effecting selective relationship between said needle jogging cam means and said needle jogging follower means and between said feed cam means and said feed follower means to produce, in sequence, a first bar stitching, a first set of side stitching, a second bar stitching, and a second side stitching, each of said stitchings for a given buttonhole pattern have predetermined proportional widths; and a stitch width regulating device comprising proportioning means connecting said needle jogging follower means to said needle support means and connected to said control dial to be controlled thereby to control, automatically, the bar stitching width and side stitching width suitably proportioned according to different sized ones of said various buttonhole patterns.

2. A control device as set forth in claim 1 wherein said stitch width regulating device comprises:

a pointed end of a zig-zag controlling that engages a cam surface of a wobble plate pivotally mounted on a stud in the sewing machine and oscillated by said needle jogging cam means; and shifting means controlled by said dial for shifting said pointed end toward and away from said stud in response to turning of said control dial from a position selecting one of said plurality of indicated buttonhole stitch proportions to another of said plurality of indicated buttonhole stitch proportions.

3. A control device as claimed in claim 2 wherein a control lever rotatably mounted on a shaft fixed in the sewing machine is connected with said control dial so as to be rotated thereby, said control lever having a pointed end arranged to influence the position of said zig-zag control link along said wobble plate cam surface.

4. A control device as claimed in claim 3 wherein a control plate with a slanted part is carried in said sewing machine in position to be acted upon by the control lever, and in which said control lever includes a plurality of pointed ends individually adjustable and located an appropriate distance apart.

5. A control device as claimed in claim 4 wherein said pointed ends are located slightly apart from said slant part of said control plate when patterns other than buttonhole stitch patterns are selected; wherein a lower one of said pointed ends contacts a vertical part of said control plate to position said zig-zag control link when larger buttonhole patterns are selected; and wherein an upper one of said pointed ends contacts said vertical part of said control plate to further move said zig-zag control link when smaller buttonhole patterns are selected.

* * * * *